US006854127B1

(12) United States Patent
Kanemitsu

(10) Patent No.: US 6,854,127 B1
(45) Date of Patent: Feb. 8, 2005

(54) BROADCAST RECEIVING AND FAILURE RESISTANT RECORDING APPARATUS

(75) Inventor: Hiroyuki Kanemitsu, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 374 days.

(21) Appl. No.: 09/717,228

(22) Filed: Nov. 22, 2000

(30) Foreign Application Priority Data

Dec. 9, 1999 (JP) ..... 11-350397

(51) Int. Cl.[7] ..... H09N 5/445

(52) U.S. Cl. ..... 725/58; 714/47; 714/748; 348/460

(58) Field of Search ..... 348/460, 553, 348/552, 192; 386/83, 113; 725/58, 93, 65; 711/162, 161, 165; 358/405, 407; 714/1–3, 47, 48, 748

(56) References Cited

U.S. PATENT DOCUMENTS

| | | | | |
|---|---|---|---|---|
| 5,036,518 A | * | 7/1991 | Tseung | 714/748 |
| 6,124,947 A | * | 9/2000 | Seo | 358/405 |
| 6,173,112 B1 | * | 1/2001 | Gruse et al. | 386/83 |
| 6,182,200 B1 | * | 1/2001 | Duvall | 711/165 |
| 6,396,544 B1 | * | 5/2002 | Schindler et al. | 348/461 |
| 6,434,323 B1 | * | 8/2002 | Hayashi | 386/104 |
| 6,460,076 B1 | * | 10/2002 | Srinivasan | 709/219 |

FOREIGN PATENT DOCUMENTS

| | | |
|---|---|---|
| JP | 6-216720 | 8/1994 |
| JP | 9-322105 | 12/1997 |
| JP | 10-093393 | 4/1998 |
| JP | 11177511 A | 2/1999 |
| JP | 11-68598 | 3/1999 |
| JP | 11-177939 | 7/1999 |
| JP | 11-252494 | 9/1999 |
| JP | 11-259928 | 9/1999 |

* cited by examiner

*Primary Examiner*—Victor R. Kostak
(74) *Attorney, Agent, or Firm*—Finnegan, Henderson, Farabow, Garrett & Dunner, LLP

(57) ABSTRACT

A broadcast receiving apparatus is equipped with a function appropriately dealing with a failure in broadcast recording. Along with broadcast content, incidental information allowing identification of the broadcasting content is received. The incidental information is preferably digital broadcast program sequence information. The receiving apparatus records the received broadcast content. When recording of certain content fails, an alternative broadcast content providing the same content is retrieved on the basis of the incidental information, and recording thereof is promoted by a rerecord promote processing unit. The recording of the alternative broadcast content is reserved or the user is alerted to the existence of the alternative broadcast. The incidental information is effectively utilized to link together sound recorded content positioned immediately before and after the content of which sound recording has ended in failure. Furthermore, effective use is made of the incidental information to obviate double recording of content so that memory is conserved.

12 Claims, 10 Drawing Sheets

EIT (EVENT INFORMATION TABLE)

| PROGRAM ××××  | |
|---|---|
| TITLE OF SONG | RECORDING SUCCESS OR FAILURE |
| A A A A | ○ |
| B B B B | × |
| C C C C | ○ |
| D D D D | ○ |
| ⋮ | ⋮ |

BROADCAST RECEIVING AND FAILURE RESISTANT RECORDING APPARATUS

BACKGROUND OF THE INVENTION

1. Field of the Invention

The present invention relates generally to a broadcast receiving apparatus, and, more particularly, to an improvement in recording functionality (sound recording, image recording, etc.) of broadcast content (content) for such an apparatus. The broadcast content may refer to the entirety of a program or a part of the program. The present invention is especially suitable for a transportable broadcast receiving apparatus, such as a car stereo system.

2. Description of the Related Art

Present forms of digital broadcasting include satellite, ground wave television, and ground wave radio broadcasting. Portable broadcast receiving apparatuses, including those mounted in vehicles, allow users to enjoy broadcasts or acquire useful information. Development advances toward practical digital music broadcasting adapted for vehicle or other mobile reception.

One digital broadcast receiving and reproducing apparatus equipped with a sound recording function is disclosed in Japan Patent Laid-Open Pub. No. Hei 11-177511. All music received is temporarily recorded. Then, when the user issues a designation of recording, the recording of a designated song is determined. It is thereby possible to avoid recording errors or failure stemming from an inadvertent mistake, such as a user forgetting to program the recording operation prior to the start of a broadcast.

It is, however, possible for broadcast recording to fail, even if no mistakes have been made. For example, variations in the status of reception may lead to data being lost, thereby rendering the recording defective. A receiving apparatus equipped with a function also providing appropriate measures against this type of failure in recording is therefore desired. Presently, however, recording management relies on a user's own memory. If a recording has once failed, the user must remember to seek and record the same broadcast content later.

On the other hand, a user may forget that they have already recorded a particular broadcast and then record the same broadcast content once again. Duplicate recording wastes recording memory capacity and, from this viewpoint, this is also a failure in recording. Presently, as stated above, to avoid such a failure, recording managed relying on a user's own memory.

The above deficiencies are particularly outstanding in vehicle-mounted broadcast receiving apparatuses, as will be described hereinbelow.

It remains uncommon for vehicle-mounted broadcast receiving apparatuses to have a recording function for recording images or sounds. However, as digital broadcasting becomes more common, it will be possible for even mobile equipment to create high-quality recordings. It is therefore preferred that mobile or vehicle-mounted broadcast receiving apparatuses also be equipped with recording functions.

However, the status of reception a portable unit is subject to large variation as a result of motion. Even slight movement of the unit may cause a shift from a receivable state to an unreceivable state. Some sites may be unreceivable in certain locations. Such variation in the status of reception experienced midway through recording could lead to complete failure of recording. In this manner, irrespective of the convenience arising from an capability to record broadcast content while moving, it is disadvantageous if there is a high risk of failure in recording.

Known portable receiving apparatuses are also disadvantageous from the viewpoint of double recording as described above. Because transportable broadcast receiving apparatuses are configured to be relatively small in size, their memory capacity may also be restrained. In addition, the spatial restraint in the operation devices such as switches may also lead to omission of a function for a user to readily check the already recorded broadcast content. Furthermore, some vehicles, such as family automobiles, are used by a plurality of users so that broadcasting content recorded by one user may be recorded again by another user.

Although, the description was made focusing on the related art problems involved with portable broadcast receiving apparatuses, such problems are not limited to mobile apparatuses.

SUMMARY OF THE INVENTION

The present invention was conceived in view of the above problems. It is therefore an object of the present invention to provide a broadcast receiving apparatus equipped with a function for appropriately dealing with potential failure which may occur during broadcast recording.

In order to achieve the above object, according to a first aspect of the present invention there is provided a broadcast receiving apparatus comprising reception means for receiving broadcast content and incidental information allowing identification of the broadcast content; recording means for recording the broadcast content received; and rerecord promotion means for promoting, when recording of a broadcast content has ended in failure, the recording of an alternate broadcast providing the same content as in the failed recording, decided on the basis of the received incidental information.

As used herein, broadcast content refers to, for example, songs or pieces of music in a music broadcast, or images and sound in a television broadcast. The broadcast content may refer to the entirety of a broadcast program, or to a part of a broadcast program (e.g., each song in a music program). Incidental information sent together with the broadcast content is used for the identification of the broadcast content, and more specifically this information preferably contains identification information and schedules of the broadcasting content. The identification information can contain any information available for the identification. The incidental information is preferably program sequence information standardized in digital broadcasting. The program sequence information can be used to identify and retrieve specific broadcast content.

According to the present invention, when the attempted recording of broadcast content has failed, the incidental information is used as a basis for searching for an alternative broadcast content providing the same content. For example, a search is made for a rebroadcast of the program, the recording of which ended in failure. In another example, a search is made for another music broadcast, the recording of which ended in failure. Promotion of recording of such alternative broadcast content enables restoration of a failed recording.

The rerecord promote means may perform recording reservation processing of the alternative broadcast content. The alternative broadcast is automatically recorded to achieve the initial recording object. The rerecord promote means may post the user on information on the alternative broadcast content.

According to a second aspect of the present invention there is provided a broadcast receiving apparatus comprising reception means receiving broadcast content and incidental information allowing identification of the broadcast content; record means recording the broadcast content received; and linkage processing means linking together, when recording of a broadcast content has ended in failure, broadcast content that is positioned immediately before and after the broadcast content, the recording of which has ended in failure, by use of the incidental information.

According to the present invention, two broadcast content is linked together that are positioned immediately anterior and posterior to a broadcast content, the recording of which has ended in failure. For example, upon the recording of a music program, data on a failingly recorded song are deleted and data on songs immediately before and after the failed song are linked together. By virtue of this, when reproducing the recorded broadcast content, reproduction is advantageously prevented from being interrupted midway through it.

In particular, use of the incidental information allows an easy recognition of a pause at the trailing end of the broadcast content anterior to a failure and a pause at the leading edge of the broadcast content posterior to the failure. Therefore, the broadcast content after linkage can smoothly continue at the linkage portion, to enable the influence of the failure in sound recording to be suppressed.

Preferably, the broadcast receiving apparatus further comprises supplement means acquiring an alternative broadcast content providing the same broadcast content as the broadcast content, the recording of which has ended in failure, on the basis of the incidental information, the supplement means inserting the acquired alternative broadcast content into the linkage portion, to thereby achieve the supplement of the broadcast content. By virtue of this, the broadcast content lost due to the failure is obtained to achieve acquisition of a full broadcast content.

It is to be understood in linkage of the broadcast content that the data need not actually be arrayed on the record medium. It will suffice that the broadcast content is correlated with each other so as to be reproducible in a successive manner.

The preferred broadcast receiving apparatus of the present invention further comprises failure information presentation means presenting information on a failure in broadcast content recording to the user. This enables the user to readily recognize which broadcast content has failed in appropriate recording.

According to a third aspect of the present invention there is provided a broadcast receiving apparatus comprising reception means receiving broadcast content and incidental information allowing identification of the broadcast content; record means recording the received broadcast content together with the incidental information; and obviation processing means comparing incidental information on a broadcast content to be newly recorded with incidental information on broadcast content that have already been recorded in the record means, to thereby obviate double recording of broadcast content.

According to the present invention, it can be judged by use of the incidental information whether the same broadcast content is about to be recorded once again. This avoids a vain memory consumption arising from the double recording.

The obviation processing means may post the user on the presence of the same broadcast content that has already been recorded. The obviation processing means may prohibit recording of the same broadcast content as an already recorded broadcast content.

As set forth hereinabove, according to the present invention, effective use is made of incidental information, e.g., digital broadcast program sequence information, fed together with the broadcast content, whereby improved measures against a failure in the broadcast recording are provided to render the broadcast receiving apparatus convenient.

It will be appreciated that the aspects of the present invention are not limited to the receiving apparatus. Other aspects of the present invention can include, e.g., a broadcast reception method, a broadcast recording apparatus or method, and a record medium having thereon recorded a broadcast recording program to be executed by the computer of the broadcast receiving apparatus.

DESCRIPTION OF THE PREFERRED EMBODIMENTS

The present invention will now be described with reference to the drawings which illustrate preferred embodiments thereof. These examples and drawings are provided to explain, and not to limit, the invention.

Embodiment 1

Figure 1:
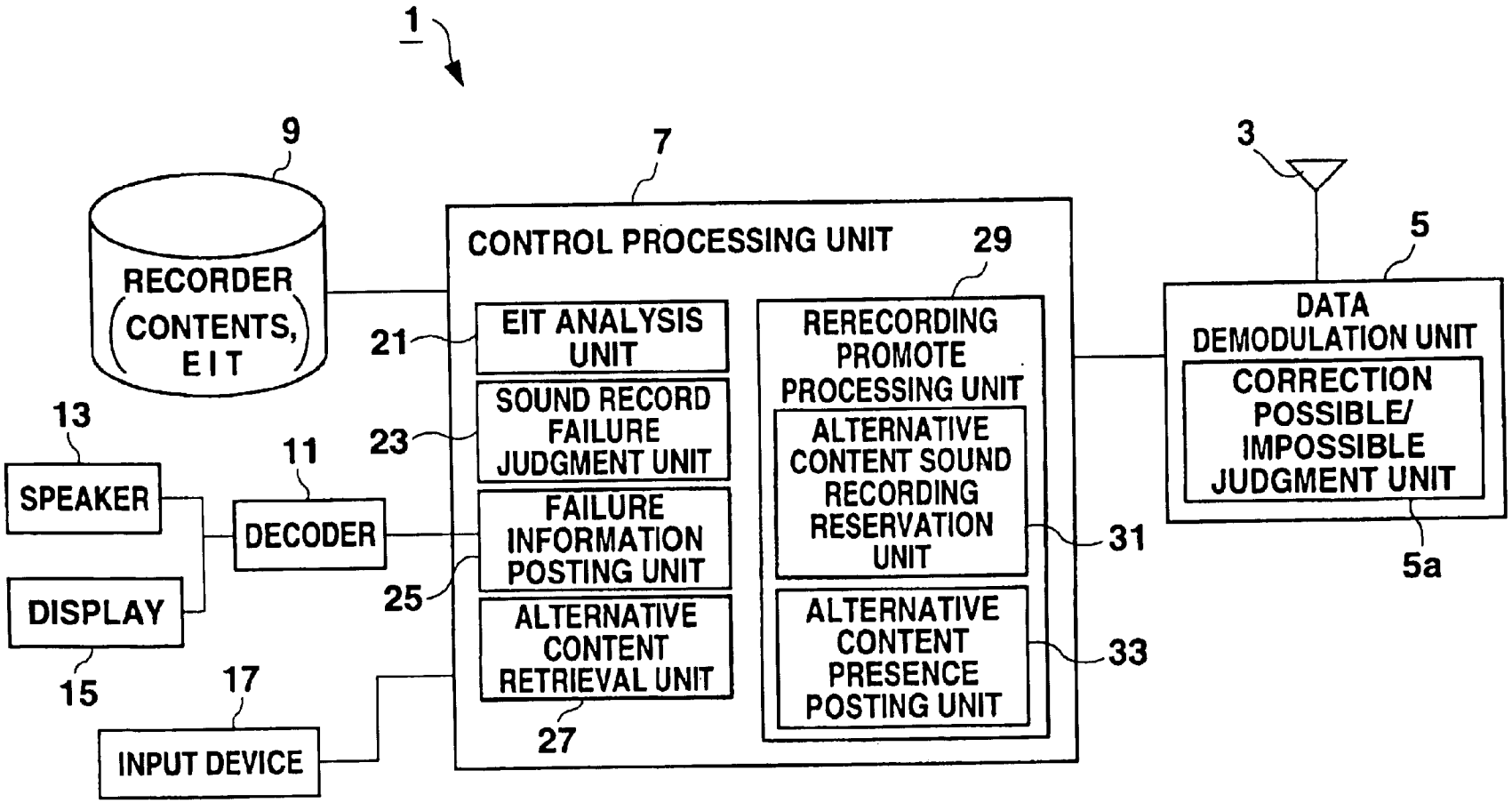
FIG. 1 is a block diagram showing a general configuration of a broadcast receiving apparatus according to a first embodiment of the present invention.

FIG. 1 shows a general configuration of a broadcast receiving apparatus in accordance with a first preferred embodiment of the present invention. In this first embodiment, the present invention is applied to a digital broadcast receiver installed in a motor vehicle.

In the following description, a "music program" typical of music broadcasting is described as an example of broadcast programs to be received. As used herein, "one-unit broadcast content" refers to individual "songs or pieces of music" making up the music program. The broadcast content is hereinafter referred to simply as "content".

Referring first to FIG. 1, the broadcast receiving apparatus is generally designated as 1 and comprises an antenna 3 receiving digital broadcast signals, a data demodulation unit 5 demodulating the broadcast signals received by the antenna 3 into digital data, a control processing unit 7 providing a control of the entire receiver, a recorder 9 for recording the received data, a decoder 11 generating audio signals and visual signals for output, a speaker 13 and a display 15 providing the audio signals and the visual signals as their respective outputs, and an input device 17 operated by a user.

The recorder 9 can be one capable of recording data by use of an electrical, magnetic, or optical technique, such as a hard disk, a memory card, or the like. A recording medium can be removably mounted on the recorder 9.

A digital broadcast signal sent to the receiving apparatus 1 includes content and incidental information. In the example illustrating this embodiment, description is made mainly of music content, as stated above. Recording or other processes in accordance with the present invention will apply to image and sound in television broadcasting content as they do to music content, although the output modes differ. The incidental information, on the other hand, is digital broadcast program sequence information which will be described later.

The music content is demodulated by the date demodulation unit 5, converted by the decoder 11 into output signals, and provided as outputs from the speaker 13. Images enhancing the music experience may be received and appear on the display 15. The demodulated content is recorded by the recorder 9. The thus recorded content is thereafter read out for reproduction. The input device 17 accepts user requests such as selection, sound recording, reproduction, and reservation of content.

It is preferable to employ the following processing for the recording process. That is, it is preferable to temporarily hold the received content, irrespective of whether the content is actually recorded, to save the content. Then, only when the user has performed a sound recording operation, the sound recording of the temporarily held content is determined. In the absence of the sound recording operation, the temporarily held content is deleted when the song has completed, or when the memory has become full. In this way, users are able to record a complete song, even when they do not decide to record that song until midway through playback.

Information allowing identification of the content can be received as incidental information. More specifically, information containing content identification and schedule information in any form is preferred.

This embodiment makes effective use of the program sequence information as one form of incidental information. The program sequence information may be as defined in defined in "Program sequence information for use in digital broadcasting" (ARIB STD-B10) standard established by the Association of Radio Industries and Businesses. According to these standards, EPG (electric program guide) is acquired from EIT (event information table).

EIT information is received by the antenna 3 at a predetermined interval (e.g., every two seconds). The EIT information is demodulated by the data demodulation unit 5, and then processed by the control processing unit 7.

Ordinary use of EIT includes extracting desired information through the EIT information analysis by the control processing unit 7. Information to be displayed is acquired from the EIT information in response to user operation of the input device 17. The thus acquired information is processed for output, sent to the decoder 11 for conversion into visual signals, and then displayed on the display 15.

The EIT information contains information corresponding to the television and radio schedules published in newspapers. For example, a stream of EIT information contains information on program schedules and program content of each of a plurality of channels lying within that stream. The receiving apparatus and broadcasting system may be configured so as to acquire plural streams of information (information in the form of in-reception and out-of-reception streams).

Figures 2, 3:
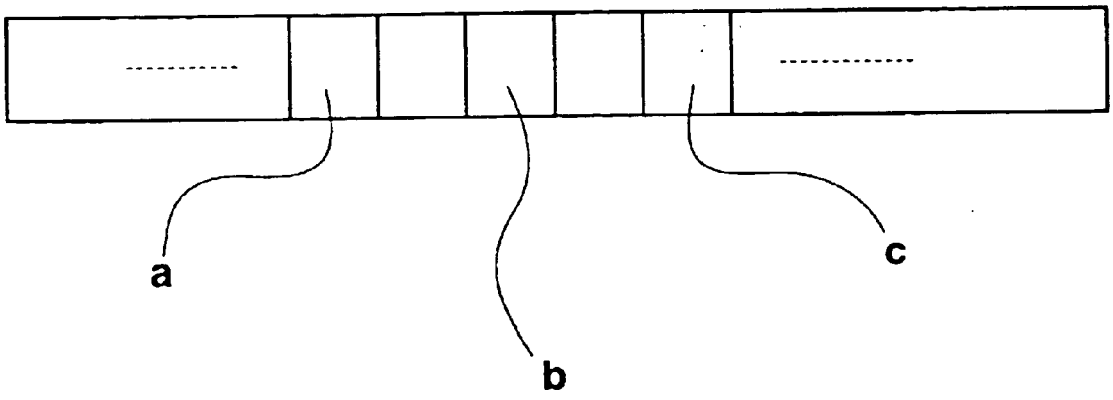
FIG. 2 illustrates EIT information contained in a digital broadcast signal.
FIG. 3 illustrates a recording failure information display process effected by the broadcast receiving apparatus of FIG. 1.

As shown in FIG. 2, the standards allow the EIT information to contain various descriptors, which may be, for example, a shortened format event descriptor a indicative of the title of a program, a content descriptor b indicative of the genre of the program, and an extended format event descriptor c indicative of information on the explanation of the program. The extended format event descriptor includes plural items of information set therein. That is, set in the music broadcast are a plurality of items such as the song title, artist, and composer.

The EIT information contains information indicating the start and end time of each content item. For example, from the EIT is obtained information on the start time and length of each song in a music program, and from this the ending time is obtained.

Referring back to FIG. 1, of the recording related processing of the present invention utilizing the EIT information as incidental information for identification in the content record will next be described.

The control processing unit 7 comprises, for features related to the present invention, an EIT analysis unit 21, a sound record failure judgment unit 23, a failure information posting unit 25, an alternative content retrieval unit 27, and a rerecord promote processing unit 29. The rerecord promote processing unit 29 includes an alternative content sound record reservation unit 31 and an alternative content presence posting unit 33.

The EIT analysis unit 21 analyzes the above-described EIT information to acquire various related information. By using the EIT information, it is possible to identify all content and acquire additional information.

The sound record failure judgment unit 23 judges whether sound recording of music content by the recorder 9 has ended in failure. The judgment of presence or absence of the sound record failure is made on a content-by-content (i.e., song-by-song) basis.

For judging sound record failure, information as to whether or not data demodulation error correction by the data demodulation unit 5 is possible is relied on. This information is sent from a correction possible/impossible judgment unit 5*a* to the control processing unit 7. When the motor vehicle moves, the status of reception may vary. If the vehicle should pass through an area of poor reception, sound data to be recorded may not be correctly be obtained. Incomplete or incorrectly received data results in error correction being impossible. When the error correction is infeasible, it is judged that a sound record failure has occurred.

Recording failure is not attributable to only the state of reception. The sound record failure judgment unit 23 monitors data writing of the recorder 9 and, when a write error is detected, it is similarly judged that a sound record failure has occurred.

The failure information posting unit 25 provides the user with information on the sound recording failure. For example, the unit performs processing for recording the title of the song for which recording failed, the title of the program, the ratio of unrecorded data, etc., together with processing for the display on the display 15. The failure information may be included, for posting, in the full sound record results. As shown in FIG. 3, for example, on the display 15 there appears a table indicating whether or not sound recording has successfully been completed.

The alternative content retrieval unit 27 retrieves an alternative content providing the same content as the content for which sound recording ended in failure. In this case, the content is a "song". The same song is thus retrieved as the song for which sound recording has ended in failure.

The retrieval is made by use of EIT information. The EIT information contains information corresponding to a programming schedule of a newspaper. The schedule of songs to be broadcast in each program are obtained from the EIT information. Information on target song is thus retrieved to obtain information on a program broadcasting the song, the channel, and broadcast time of the program and the target song.

The rerecord promote processing unit 29 performs processing for promoting the recording of the alternative content retrieved. The rerecord promote processing unit 29 includes the alternative content sound record reservation unit 31 and the alternative content presence posting unit 33. The alternative content sound record reservation unit 31 makes an automatic reservation of sound recording of the alternative content. The alternative content presence posting unit 33 provides information on the existence of an alternative content (including time, channel, etc.) to the user by way of the display 15.

Figure 4:
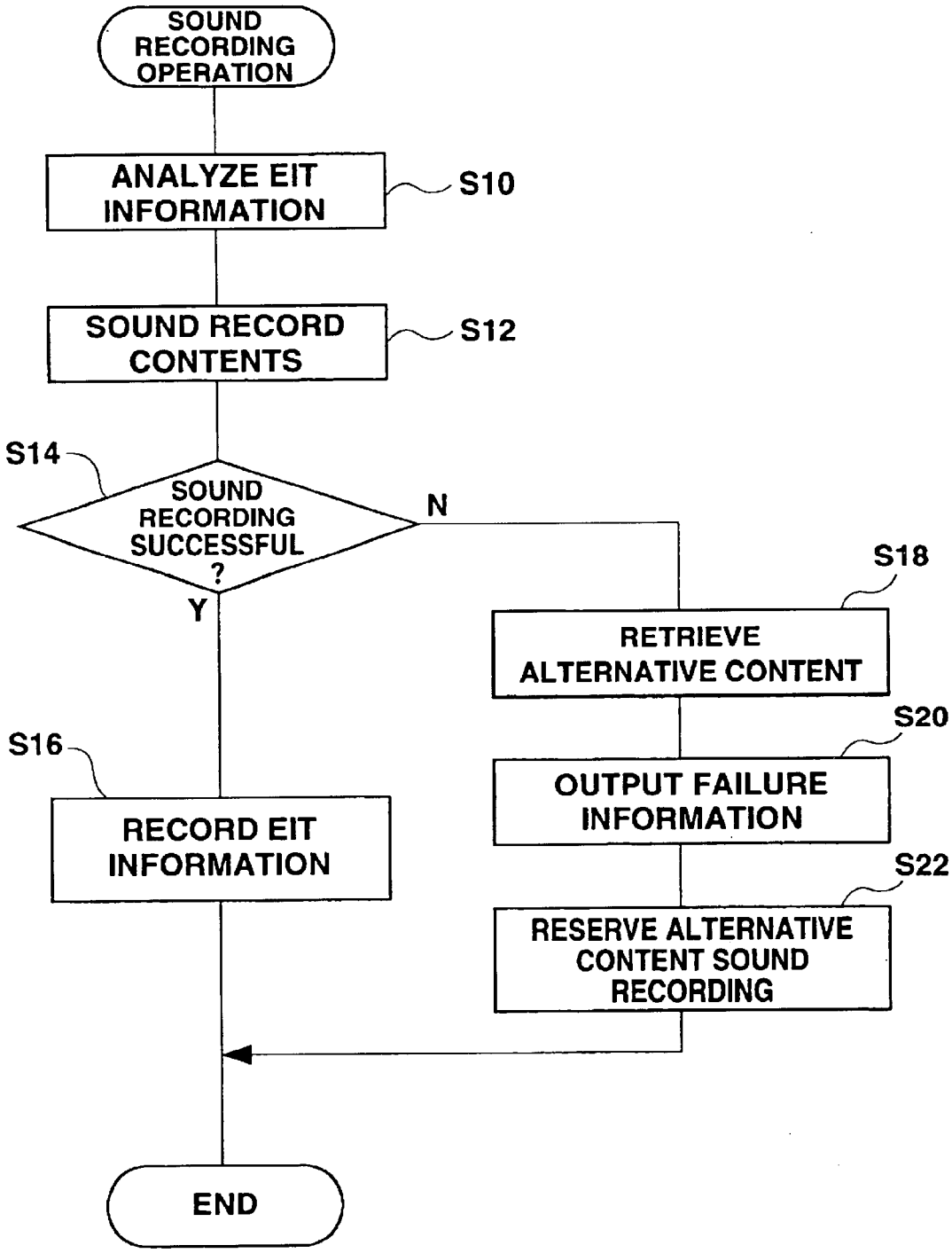
FIG. 4 is a flowchart showing a sound recording process effected by the broadcast receiving apparatus of FIG. 1.

FIG. 4 is a flowchart showing an example processing of the sound recording related to the above-described features. When the user performs a sound recording operation, the processing shown in FIG. 4 starts. The sound recording operation includes a sound recording designating operation of a program and a sound recording reservation designating operation.

In the processing shown in FIG. 4, EIT information is first analyzed to acquire information (event information) such as extended format event descriptors and shortened format event descriptors (Sic). Sound recording is made of target content selected by the user (S12) and it is judged whether or not the sound was successfully recorded (Sl4). If affirmative, then EIT information on the sound recording target is recorded together with the content (S16). The recorded information contains the above event information and can be utilized for identification of the recorded content.

On the other hand, if it is judged in S14 that the sound recording has ended in failure, retrieval of an alternative content is made by use of the EIT information (S18). The user is then posted on failure information (S20). In this case, as described above, the failure information appears on the display. The speaker may generate an alarm sound or a speech sound to inform the user of recording failure. Sound recording reservation processing of the alternative content is then automatically carried out (S22) to bring the processing to an end. The receiving apparatus enters a sound recording standby mode, in which operates the alternative content sound recording reservation unit 31 of the rerecord promote processing unit 29.

When the next broadcast time arrives, it is very possible that the motor vehicle may not be in use, with the broadcast receiving apparatus switched off. In such an event, the apparatus will retrieve the next alternative content and reserve sound recording of that next choice. This applies, where appropriate, to the subsequent processes as well.

Figure 5:
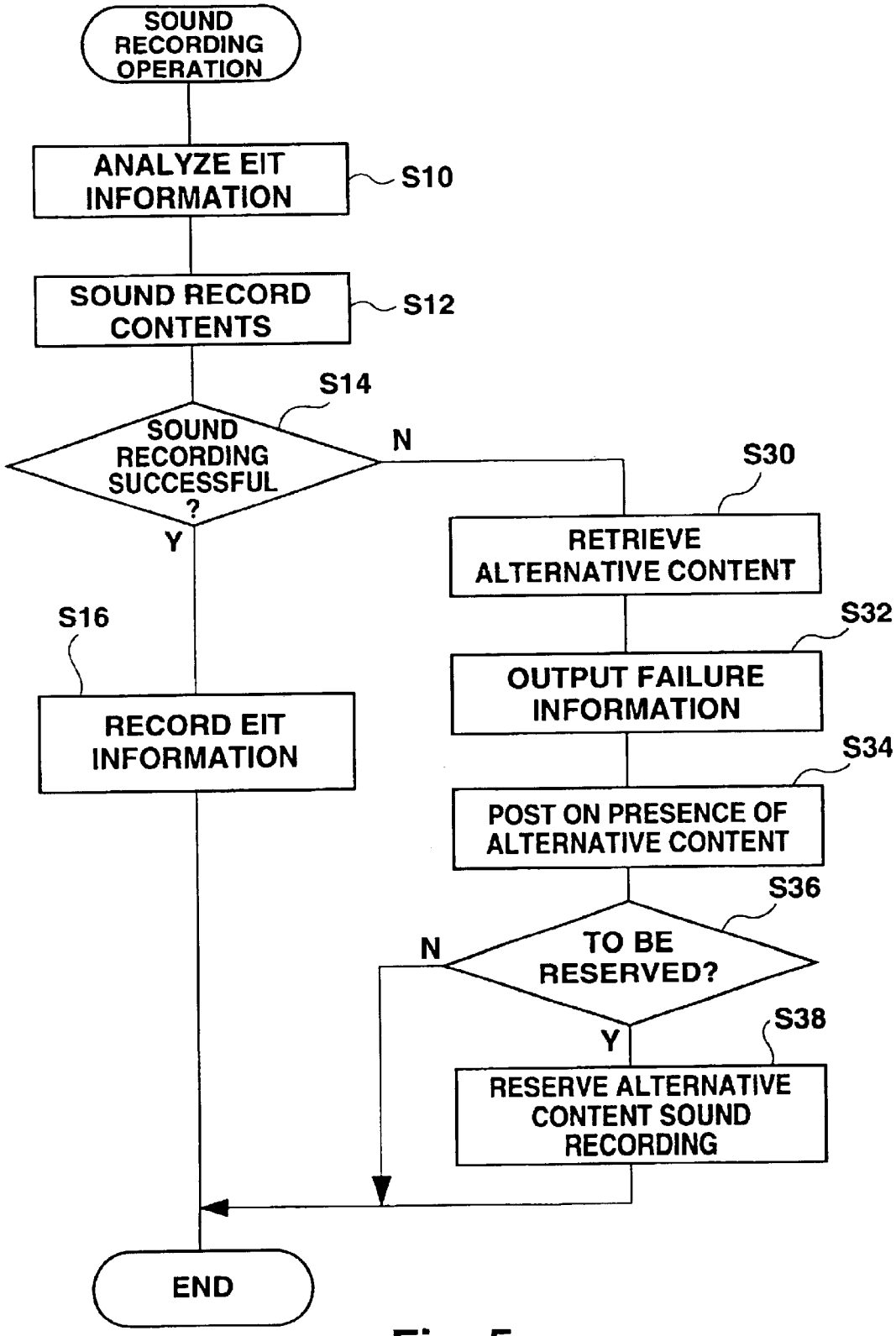
FIG. 5 is another flowchart showing the sound recording process effected by the broadcast receiving apparatus of FIG. 1.

FIG. 5 is a flowchart showing another example of sound recording processing effected by the apparatus of FIG. 1. S10 to S16 are the same as FIG. 4. The most significant difference from the device shown in FIG. 4 lies in processes subsequent to the detection of a sound recording failure at S14.

In this configuration, if the decision is negative in S14, an alternative content is retrieved (S30) and the user is informed of failure (S32). The user is then informed of the existence of an alternative content (S34). The alternative content presence posting unit 33 of the rerecord promote processing unit 29 posts alternative content information on the display. When no alternative contents can be found within the obtained EIT information, that fact is displayed.

When a future content is found, the user is then asked whether or not sound recording of the alternative content is to be reserved (S36). The query may appear on the display, be provided as audible output from the speaker, or both. When the reservation is designated through operation of an input device by the user, the sound recording reservation is carried out (S38), thereafter allowing a migration to the sound recording standby mode, to thereby terminate the processing. If the user makes no designation concerning reservation, the processing merely comes to an end.

As set forth hereinabove, according to the first embodiment, when recording of certain content (broadcast content) has ended in failure, an alternative content providing the same content is searched for on the basis of the incidental information. In the above example, the alternative content is obtained by finding out another music program broadcasting of the song for which recording failed. Alternative content recording is promoted to enable restoration of a failed recording.

As discussed above, the rerecording promotion may be achieved by the alternative content automatic recording reservation processing. The user may be posted on information on the alternative content source. FIG. 4 illustrates the automatic recording reservation being carried out. FIG. 5 shows the automatic recording reservation being executed after the user is informed and user consent is obtained. The automatic reservation processing is convenient because the alternative content is automatically acquired and recorded so that the initial recording object can be achieved. The scope of the present invention covers performing either of the automatic reservation and user posting or performing another rerecording promotion.

In the example used to illustrate the first embodiment, the broadcast receiving apparatus was mounted on a motor vehicle. In vehicles the status of reception will vary to a large extent depending on the movement thereof. For this reason, even in systems where broadcasting can be recorded while the vehicle is moving, there will be a high risk of recording failure. By employing the present invention embodied as described above, it becomes possible to cope expediently with a recording failure, to facilitate the advantage of the broadcast receiving apparatus for vehicles.

This embodiment allows information on the content recording failure to be provided to the user. Thus, the user can readily recognize for which content recording has failed and choose among options for appropriate recording of that content.

Embodiment 2

A second preferred embodiment of the present invention will next be described.

Figure 6:
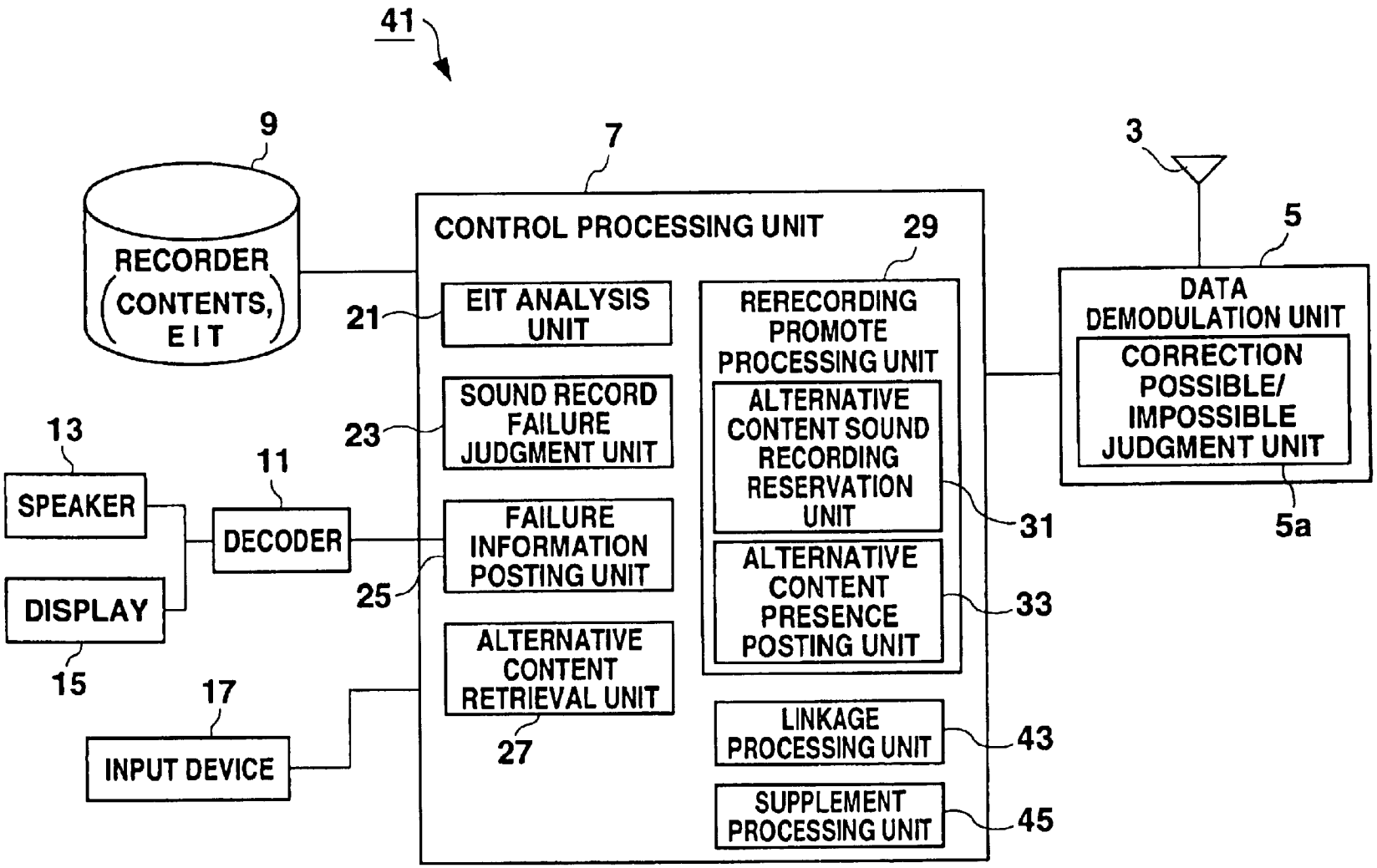
FIG. 6 is a block diagram showing a general configuration of a broadcast receiving apparatus according to a second embodiment of the present invention.

FIG. 6 shows a broadcast receiving apparatus 41 in accordance with the second embodiment of the present invention. Differing the apparatus depicted in FIG. 1, the control processing unit 7 of the apparatus 41 additionally includes a linkage processing unit 43 and a supplement processing unit 45. When a failure occurs in content recording, the linkage processing unit 43 performs processing for linking together content immediately anterior and posterior to the content of which sound recording has failed. The supplement processing unit 45 performs processing for separately acquiring the content of which sound recording has failed, for supplement. For these processings, effective use is made of the EIT information which is one form of the incidental information.

Figure 7:
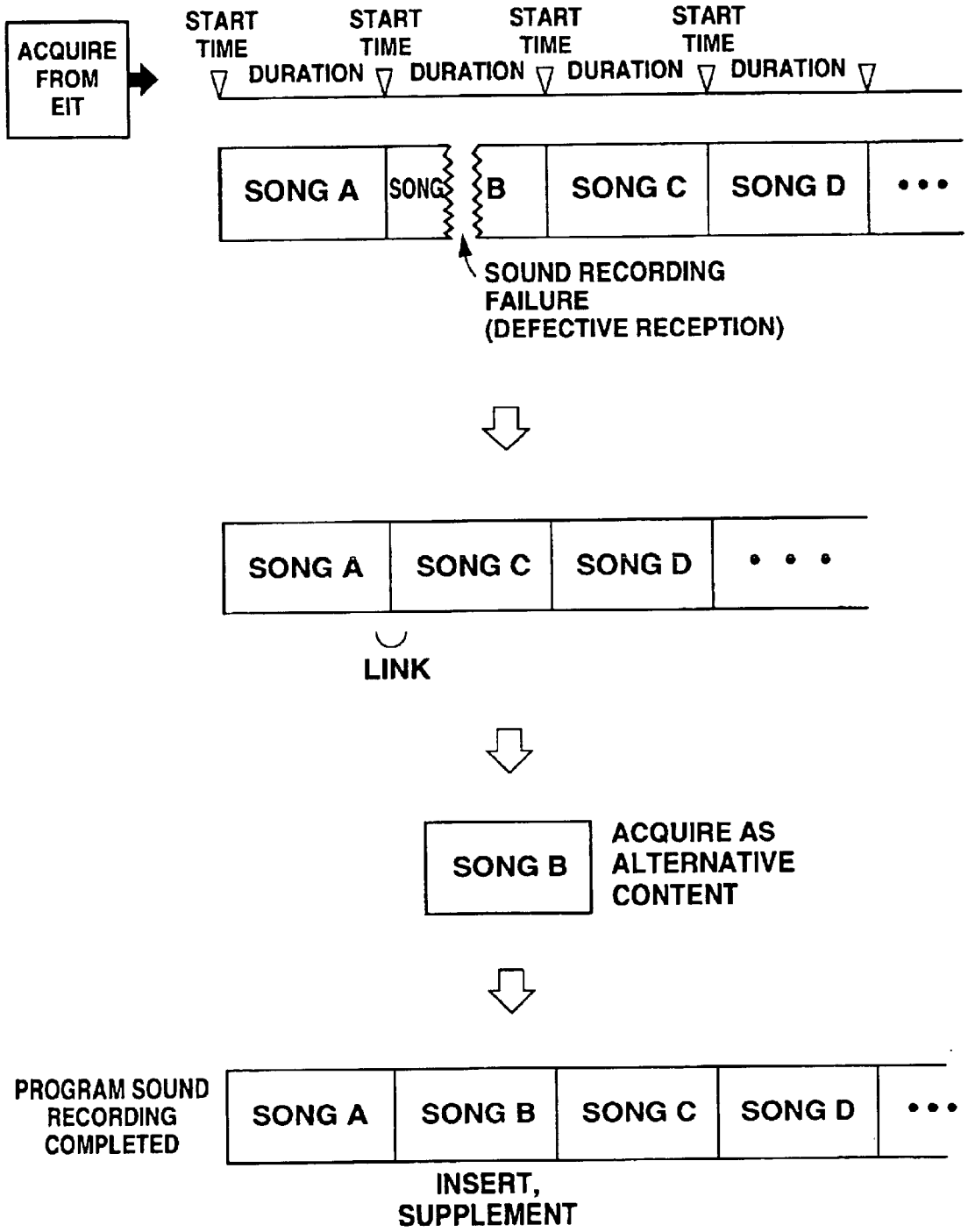
FIG. 7 illustrates a content linkage process performed after a failure in sound recording by the broadcast receiving apparatus of FIG. 6.

FIG. 7 shows functions of the linkage processing unit 43 and the supplement processing unit 45. An example will be described in which songs A, B, C and D of a music program X have been sound recorded in a successive manner and that, due to the passage of a motor vehicle through a an area of poor reception while recording song B, data on the song B have partially been lost, resulting in a failure of recording of the song B.

Based on EIT information analyzed by the EIT analysis unit 21, the linkage processing unit 43 acquires the start time and duration of each song broadcast during the program. From this information, the ending time of each song is also obtained. On the basis of this information, the songs A and C are linked together that are positioned immediately anterior and posterior to the song B, recording of which has ended in failure. Thus, the songs A, C and D are sequentially arrayed in the described order.

Data within the recorder 9 is subjected to this linkage processing. It is, however, obvious that data need not actually be physically arrayed in a linear order on a recording medium. It will suffice that the content (songs A, C and D) be correlated with one another so as to be reproducible in a successive manner.

After linkage processing, an alternative content of the lost content is retrieved in the manner described above for the first embodiment. That is, information on the next broadcast of song B is retrieved from EIT information being currently received. Then, the supplement processing unit 45 executes the sound recording reservation processing of the song B. After the acquisition of the song B, it is inserted into the linkage portion between the songs A and C to provide a complete version of lost song B.

Nevertheless, the motor vehicle and the broadcast receiving apparatus may be off during the broadcast of the alternative content (song B). In this event, as described previously, still another alternative content is retrieved for the reservation of sound recording when the motor vehicle is turned back on.

Figure 8:
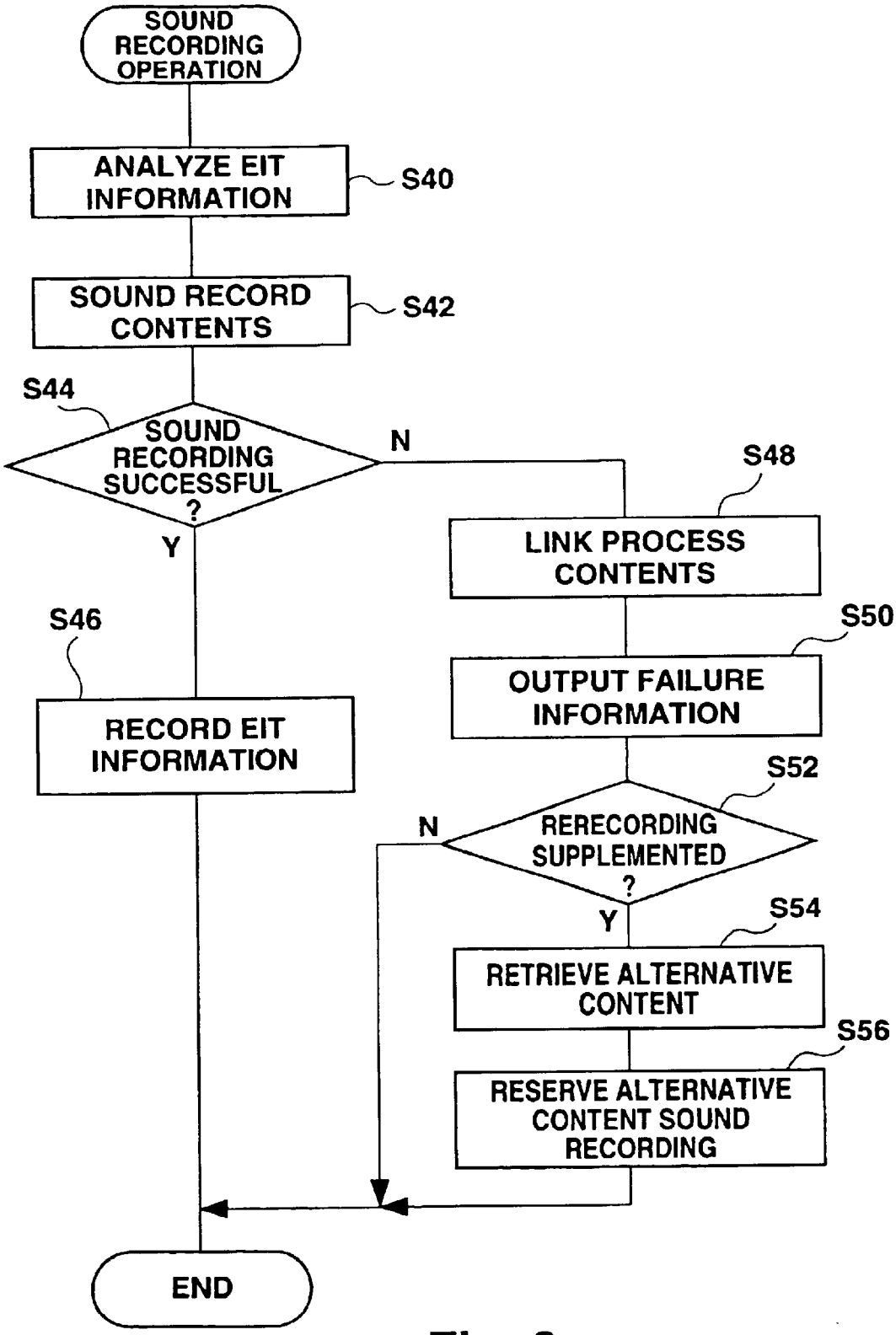
FIG. 8 is a flowchart showing a sound recording process effected by the broadcast receiving apparatus of FIG. 6.

FIG. 8 is a flowchart showing an example of the above processing. When the sound recording operation is performed by the user, the processes of FIG. 8 start. The EIT information is analyzed to acquire information from the extended format event descriptor, the shortened format event descriptor, etc. (S40). Target content is sound recorded (S42) and it is judged whether or not sound recording thereof has successfully been made (S44). If all the songs are successfully sound recorded, then the EIT information about the sound recording targets is recorded together with the content (S46). The EIT information contains the above event information and can be utilized for identification of the content recorded.

On the contrary, if it is judged in S44 that the sound recording of content (song) has ended in failure, then deletion is made of the content (song) of which sound recording has ended in failure, to link together the content that is positioned immediately anterior and posterior to that content (S48). The user is then provided with failure information indicative of a sound recording failure (S50). A list is preferably displayed that includes failed content and successful content (acquired content). A post-linkage content list is also provided on the display.

The user is then prompted as to whether or not the user wishes the failed content to be rerecorded for supplement (S52). For the query, the display or the speaker is preferably used. When the user designates the supplement, an alternative content is retrieved (S54) and sound recording reservation processing is performed (S56), entering the sound recording standby mode to terminate the series of processes. If no supplement is designated, the processing comes to an end intact.

As set forth hereinabove, according to the present invention, the content positioned immediately before and after the content for which sound recording has ended in failure is linked together that are. In the above example, data on a song of which sound recording has ended in failure is deleted, and data on songs that are positioned immediately before and after that song are linked together. By virtue of this, upon the reproduction of the recorded broadcast content, interruption in reproduction can be prevented.

In the second embodiment, especially, the end of the preceding song and the beginning of the next song are determined for linkage on the basis of information on start time, etc., contained in the EIT information. In this manner, the present invention acquires and utilizes incidental information that contains information indicating pauses of content. It is thereby possible to readily recognize a pause at the trailing edge of the pre-failure broadcast content and a pause at the leading edge of the post-failure broadcast, whereupon the broadcast content after linkage can smoothly continue through the linkage portion so that the influence of the sound recording failure is suppressed as much as possible.

Furthermore, unrecorded content is separately acquired for supplement. This processing is carried out by making effective use of the incidental information. This achieves the initial object, i.e., recording of the full broadcast content into the recorder 9.

Embodiment 3

A third preferred embodiment of the present invention will next be described.

Figure 9:
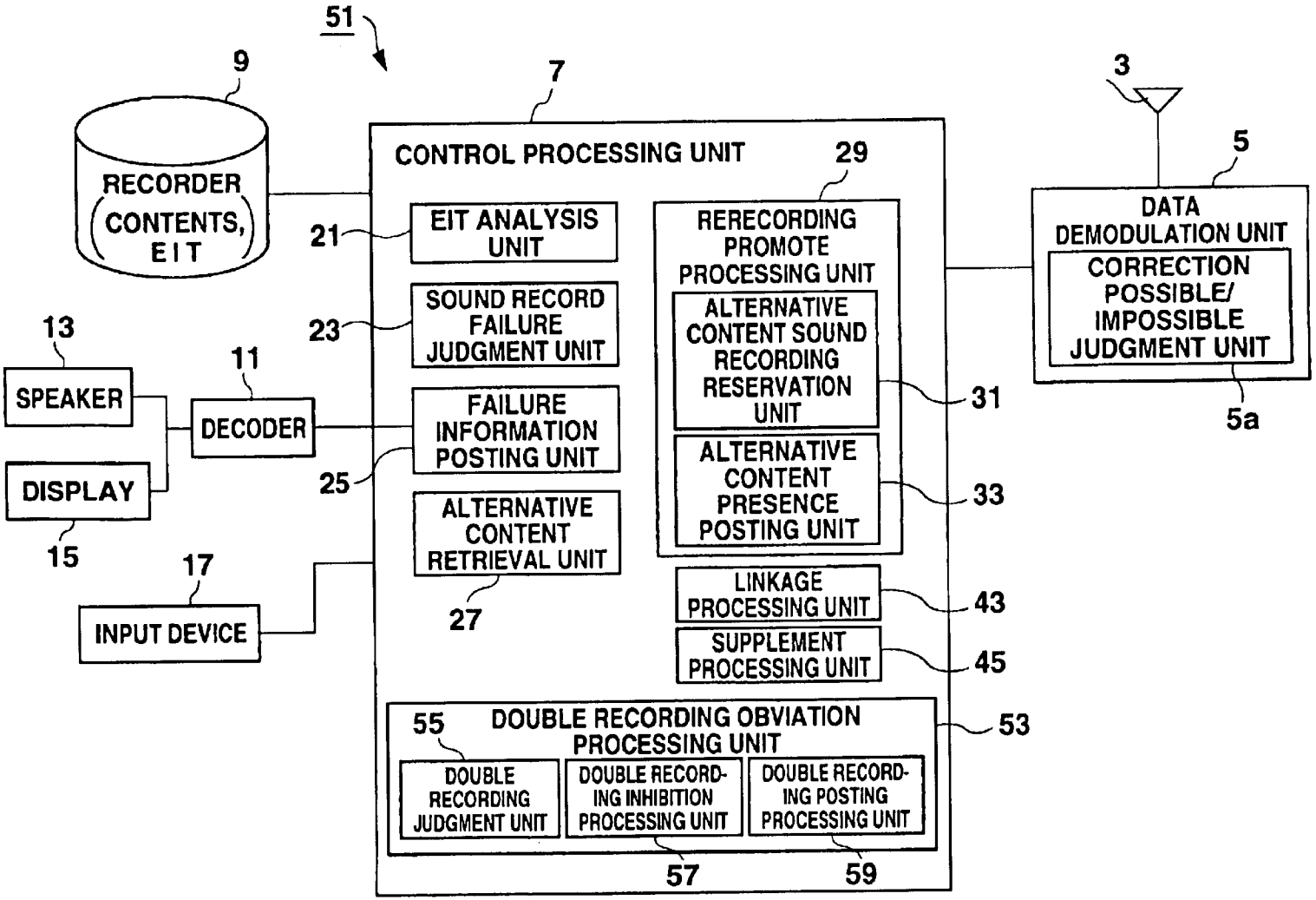
FIG. 9 is a block diagram showing a general configuration of a broadcast receiving apparatus according to a third embodiment of the present invention.

FIG. 9 shows a broadcast receiving apparatus 51 in accordance with the third embodiment. As compared with the apparatus shown in FIG. 6, the control processing unit 7 of the apparatus 51 additionally comprises a double recording obviation processing unit 53 which includes a double recording judgment unit 55, a double recording inhibition processing unit 57 and a double recording posting processing unit 59.

The double recording judgment unit 53 compares EIT information on content to be recorded in the recorder 9 with EIT information already recorded in the recorder 9 in correlation with the content, to judge whether or not any double recording has been designated.

The double recording judgment processing will next be described in greater detail.

When content is initially recorded into the recorder 9, EIT information on the content is recorded therein together with the content. By referring to this EIT information, content already recorded can be identified and specified.

Note that there is no need to record all items of EIT information related to each content. The EIT information contains various information such as extended format event descriptors, shortened format event descriptors, etc. The extended format event descriptor allows a plurality of items to be set therein. It will be sufficient to extract required information from those pieces of information for recording. This applies to the apparatus of all the embodiments without being limited to an apparatus configured according to the third embodiment of the present invention.

Provided that the content is a single song, only information required for identifying the song need be recorded. This information may be the title of the song, or the sign or number for identifying the song. Naturally, even more items of information may be recorded therein and could be utilized for other applications. For linkage processing in the above embodiment, it will be preferable to record information on the beginning and end of the song as well.

After the user has designated new content to be recorded, this designation may be given by a record designating operation of the content on the air or by a reservation designating operation thereof.

EIT information then being received is analyzed by the EIT analysis unit 21 to acquire EIT information on content to be recorded. Reference is made to EIT information on each of content item recorded in the recorder 9. Comparison is made among this information to judge whether or not a content to be recorded has already been recorded in the recorder 9. If the judgement is affirmative, it is determined that double recording is about to be carried out.

The double recording judgment is made on a content-by-content basis. For example, in case of designation of sound recording of a music program, judgement whether or not the content has already been recorded is made for each song.

When double recording is detected, the double recording obviation processing unit 53 executes processing for obviating the double recording. Herein, the double recording inhibition processing unit 57 and the double recording posting processing unit 59 operate. The double recording inhibition processing unit 57 inhibits writing of the content to be recorded into the recorder 9. The double recording posting unit 59 informs the user of the fact that the content has already been recorded, by means of the display 15 and the speaker 13. The display 15 preferably provides a list of the already recorded content. Alternatively, a list of all content to be recorded may bear the presence or absence of recording of each content. The speaker 13 issues a double recording alarm in the form of speech sounds or alarm sounds.

In the apparatus of the third embodiment, the user is asked whether or not specific content is to be recorded even though that content has previously been recorded. If execution is designated, then the content is recorded. This will be useful in a case, such as that which will be described next.

By way of example, sound recording of an entire music program may be designated. Some users may wish to record the entire program, even though some of the content is duplicated. In this case, acceding to the user's request, double recording is allowed.

Figure 10:
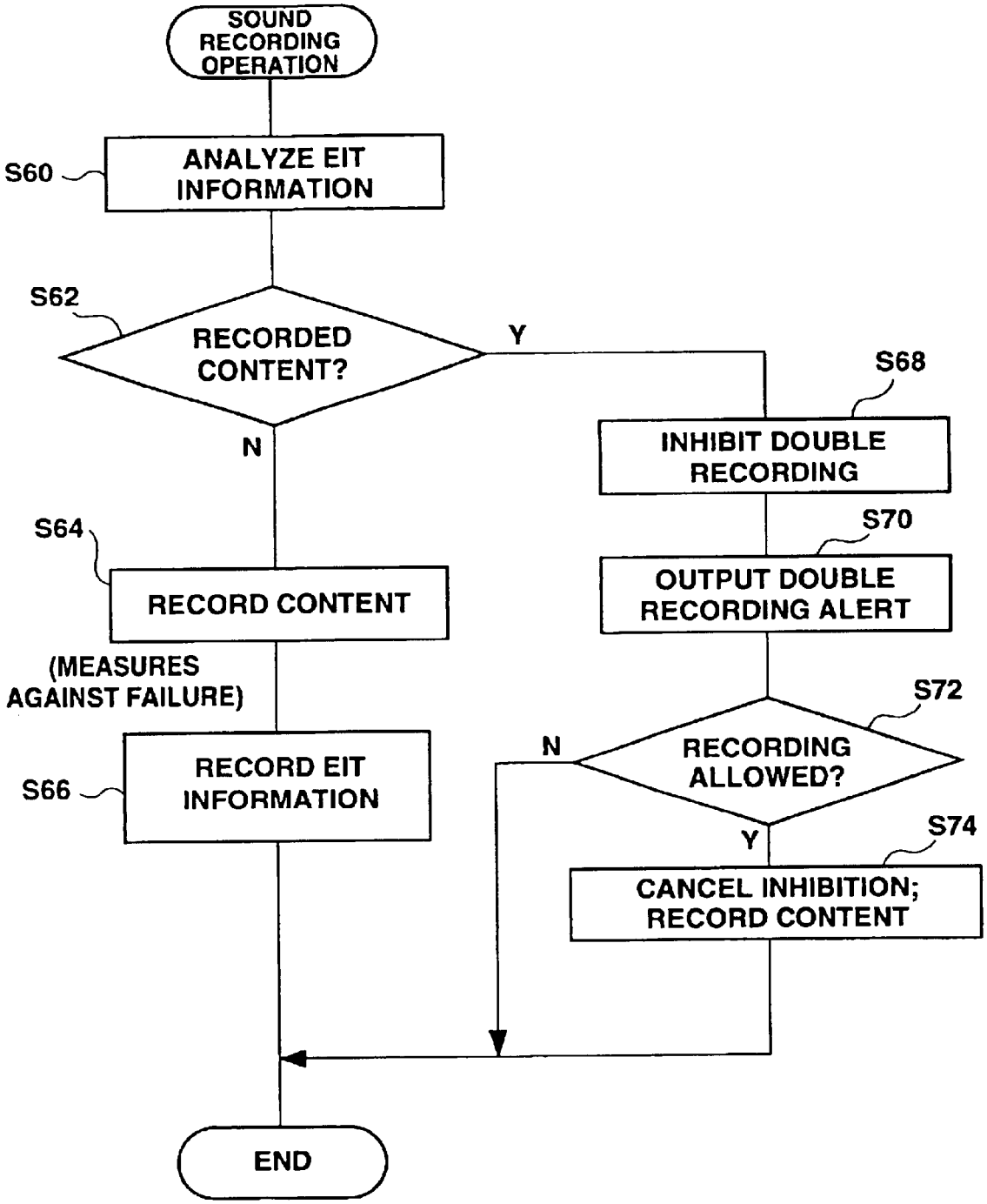
FIG. 10 is a flowchart showing a sound recording process performed by the broadcast receiving apparatus of FIG. 9.

FIG. 10 is a flowchart showing an example of the above processing. When the user performs a sound recording operation, the processing of FIG. 10 is initiated. EIT information is analyzed so that information is acquired from extended format event descriptors, shortened format event descriptors, etc. (S60). Then, it is judged whether a content has already been recorded or not, i.e., whether or not a duplicate sound recording is about to be made (S62).

If in the decision at S62 is negative, then a target content is recorded (S64). Although not shown in FIG. 10, when the recording has ended in failure, the failure measures processing described earlier is carried out. If the recording is successful, then the EIT information is recorded as information for identifying the recorded content (S66) to thereby complete the sound recording process.

If, on the other hand, the decision at S62 is affirmative, recording of the target content is inhibited (S68) and the user is informed that the content has already been recorded (S70). At that time, a list of the recorded content appears on the display.

The user is then queried as to whether or not he or she wishes to record the content, even though it has already been recorded (S72). The display 15 and the speaker 13 are utilized for the query. If the decision at S72 is affirmative, then the sound recording is released from inhibition and allowed in compliance with the designation (S74). If negative at S72, then the processing comes to an end.

As set forth hereinabove, in this third embodiment, the EIT information can be used to judge whether or not content (broadcast content) is about to be recorded a plurality of times. This makes it possible to avoid wasteful memory consumption as a result of unnecessary double recording.

It will be understood that, as described above, the user may 31 be warned of the presence of duplicate content in the obviation processing. Recording of content already recorded may be prohibited. The present invention includes performing either of the two obviation processings or performing a different obviation processing.

Similar to the first and second embodiments, the apparatus of the third embodiment provides distinct and valuable advantages for applications in vehicles such as motor vehicles.

Due to its relative small-sized configuration, the mobile broadcast receiving apparatus may have a restricted memory capacity. Also, due to the spatial restraint of the operation devices such as switches, etc., it may not be possible to include the function allowing the user to readily check the recorded broadcast content in order to prevent the double recording. Furthermore, as the apparatus may often be used by a plurality of users, content recorded by one person may be recorded again by another person.

In this manner, the broadcast receiving apparatus for vehicles provides convenient capability for recording broadcast content while moving, but disadvantageous in the that double recording is possible. According to the present invention, it is possible to obviate double recording in an effective manner and to promote the advantages of the broadcast receiving apparatus for vehicles.

While preferred embodiments of the present invention have hereinbefore been described, it will be appreciated that the present invention is not limited to the above embodiments and that those skilled in the art can modify the examples used to illustrate embodiments without departing from the scope and spirit of the present invention.

For example, in the above embodiments, the present invention has been applied to the receiving apparatus adapted for MPEG2 but is not limited thereto. The present invention is applicable to other types of digital broadcasting and also to analog broadcasting as long as it is possible to receive information for identifying the content.

The present invention is not limited to vehicle-mounted receiving apparatuses but may be applied to any portable broadcast receiving apparatus. For example, the present invention is applicable to a handheld receiving apparatus, such as a personal stereo system. The present invention is similarly applicable to the now popular handheld terminal apparatuses, such as those equipped with a position detecting function.

Furthermore, the present invention is applicable to fixed receiving apparatuses, though the effects of the present invention are more remarkably demonstrated when embodied in mobile receiving apparatuses.

The above embodiments have assumed each of songs making up a music program as one unit of the content (broadcast content). As opposed to this, an entire music program may form one content. In this case, the alternative content is preferably obtained by retrieval of a rebroadcast program. For the double recording obviation, it is preferred to obviate the double recording of the rebroadcast program. The unit of content may be an aggregate of a plurality of programs. In contrast, a content unit may be each of a plurality of elements obtained as a result of division of a single song. This will be especially effective for longer songs.

It is obvious that the content (broadcast content) should not be limited to music. The present invention is equally applicable to broadcasts of the other content. The present invention is similarly applicable to both a television broadcast or a radio broadcast. In the case of television, the unit of the content may be a single program, a part thereof, or an aggregate of a plurality of programs. In summary, the content is any mass of data on content of a broadcast itself.

The above embodiments have made use of EIT information as information for identification of content. The recorder 9 has also recorded the EIT information correlated with each content. For the processing thereof, use may be made of only the required information within the EIT information. That is, extraction, use, or recording may be made of just the information necessary for the content identification and other processings. For example, recorded are the titles of item of the extended format event descriptors, the broadcast start time, and the duration. This applies also to the use of incidental information other than the EIT information.

The present invention may otherwise be implemented as a method and a recording medium, as well as an apparatus. As a recording medium, recorded thereon is a program that allows a computer to execute the processes of the present invention. A program for implementing the processes of the present invention may be incorporated in the form of, e.g., a module into a program for processing digital broadcast signals. The medium is any medium configured to be computer readable by way of electrical, magnetic, or optical means. In the FIG. 1 apparatus, the control processing unit may be a computer, in which case the recording medium is contained in, e.g., a peripheral storage device or within the computer.

Figure 11:
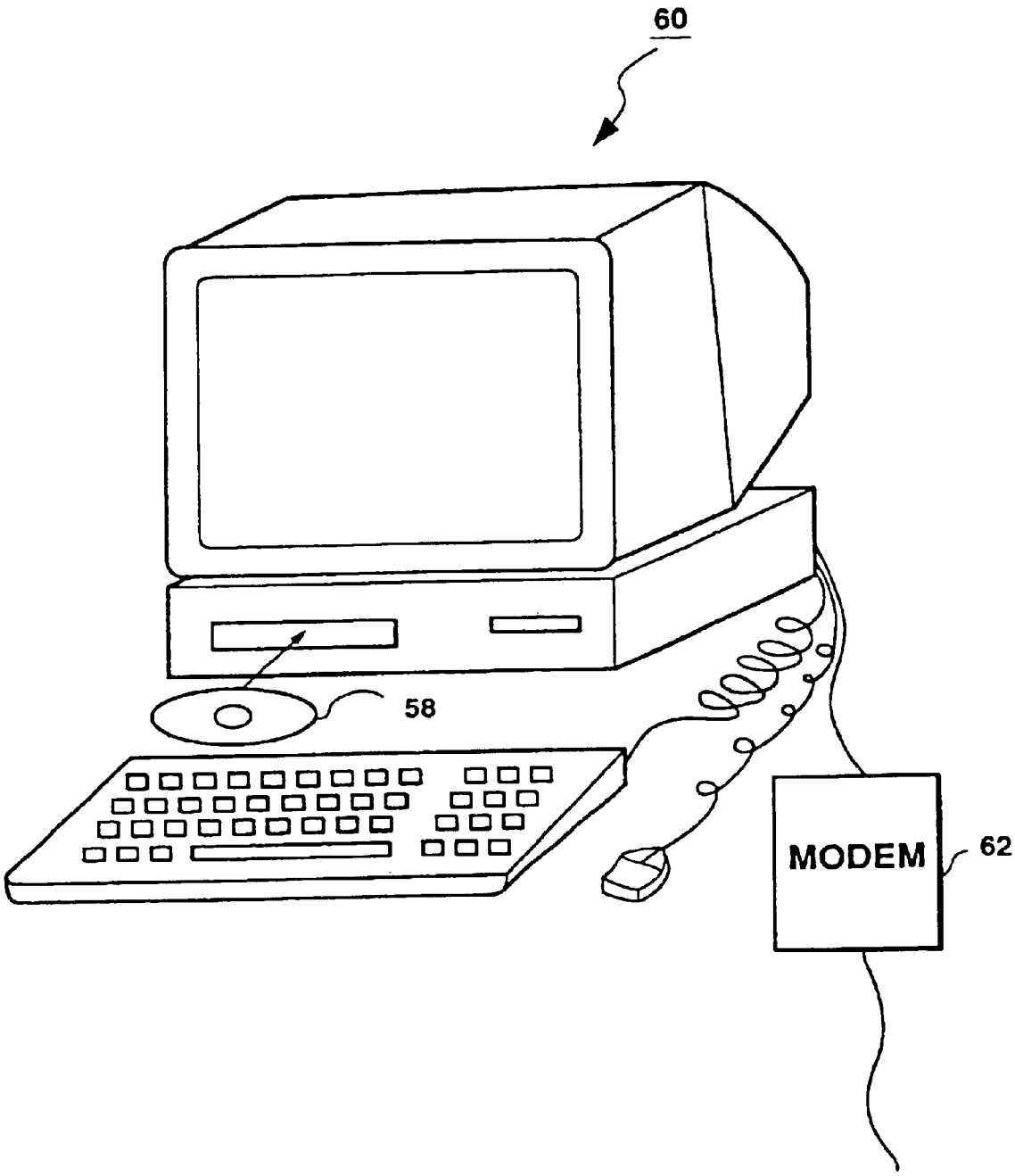
FIG. 11 illustrates the present invention embodied in the form of a computer.

Referring finally to FIG. 11, a broadcast receiving apparatus is shown by way of example that is made up of a CD-ROM 58 employed as an example of the storage medium, and a computer 60 having a processing program, etc., installed therein. Other than the CD-ROM, the storage medium can be for example a floppy disk, a magnetic disk, a magnetic tape, a RAM, a flash memory, an optical memory disk, a DVD, etc. The computer 60 may receive digital broadcast signals through an antenna not shown or by way of a modem 62, as examples. Naturally, the present invention could be embodied as a portable computer or a computer installed in the likes of a motor vehicle and would provide similar functions and present similar effects as in the examples used in the above embodiments.

As set forth hereinabove, according to the present invention, effective use is made of incidental information, e.g., digital broadcast program sequence information, fed together with the broadcast content, whereby improved measures against a failure in the broadcast recording are provided to render the broadcast receiving apparatus more convenient.

What is claimed is:

1. A broadcast receiving apparatus comprising:

reception means for receiving a first broadcast program transmitted according to a predetermined program schedule and incidental information allowing identification of said broadcast program;

record means for recording said received first broadcast program; and rerecord promote means for searching, when recording of the first broadcast program has ended in failure, for a second broadcast program other than the first broadcast program providing the same content as said failed first broadcast program, on the basis of said incidental information, and performing reservation processing for recording said second broadcast program.

2. The broadcast receiving apparatus according to claim 1, wherein said rerecord promote means outputs to the user information on said second broadcast program.

3. A broadcast receiving apparatus according to claim 1, further comprising:

linkage processing means for linking together, when recording of the first broadcast program has ended in failure, the second broadcast program other than said first broadcast program that is positioned immediately before and after said first broadcast program of which recording has ended in failure, by use of said incidental information.

4. The broadcast receiving apparatus according to claim 3, further comprising:

supplement means for acquiring the second broadcast program other than said first broadcast program providing the same content as said first broadcast program of which recording has ended in failure, on the basis of said incidental information, said supplemental means inserting said acquired second broadcast program into the linkage portion.

5. The broadcast receiving apparatus according to claim 1, further comprising:

failure information presentation means for presenting to the user information related to a failure in broadcast program recording.

6. The broadcast receiving apparatus according to claim 3, further comprising:

failure information presentation means for presenting to the user information related to a failure in broadcast program recording.

7. A broadcast receiving apparatus according to claim 1, further comprising:

obviation processing means for comparing incidental information for broadcast program content to be newly recorded with incidental information of broadcast program content that has already been recorded by said record means, to thereby preclude double recording of broadcast program content.

8. The broadcast receiving apparatus according to claim 7, wherein said obviation processing means outputs to the user information on the presence of the same broadcast program content that has already been recorded.

9. The broadcast receiving apparatus according to claim 8, wherein said obviation processing means prohibits recording of broadcast program content that is identical to broadcast program content already recorded.

10. A method of receiving and storing a broadcast, comprising the steps of:

receiving a first broadcast program transmitted according to a predetermined program schedule and incidental information that enables said broadcast program to be identified;

recording said first broadcast program received;

searching, when recording of said first broadcast program has ended in failure, for a second broadcast program other than said first broadcast program that provides the same content as said failed first broadcast program, on the basis of said incidental information, and performing reservation processing for recording said program.

11. A method of receiving and storing a broadcast, according to claim 10, further comprising the steps of:

linking together, when recording of a broadcast program content has ended in failure, broadcast program content that is positioned immediately before and after said broadcast program content of which recording has ended in failure, on the basis of said incidental information.

12. A method of receiving and storing a broadcast according to claim 10, further comprising the steps of:

comparing incidental information of a broadcast program content to be newly recorded with incidental information of broadcast program content that has already been recorded in said record means, to thereby perform processing precluding double recording of broadcast program content.

* * * * *